US009391372B2

(12) United States Patent
Hwang et al.

(10) Patent No.: US 9,391,372 B2
(45) Date of Patent: Jul. 12, 2016

(54) ANTENNA

(71) Applicant: EMW CO., LTD., Incheon (KR)

(72) Inventors: Yi Seul Hwang, Incheon (KR); Kyoung Ho Lee, Gyeonggi-do (KR)

(73) Assignee: EMW CO., LTD., Incheon (KR)

( * ) Notice: Subject to any disclaimer, the term of this patent is extended or adjusted under 35 U.S.C. 154(b) by 74 days.

(21) Appl. No.: 14/044,706

(22) Filed: Oct. 2, 2013

(65) Prior Publication Data

US 2014/0354496 A1 Dec. 4, 2014

(30) Foreign Application Priority Data

May 30, 2013 (KR) ..... 10-2013-0061791

(51) Int. Cl.
*H01Q 13/10* (2006.01)
*H01Q 1/24* (2006.01)

(52) U.S. Cl.
CPC ..... *H01Q 13/106* (2013.01); *H01Q 1/243* (2013.01)

(58) Field of Classification Search
CPC ..... H01Q 13/10; H01Q 13/106; H01Q 1/243
USPC ..... 343/767, 770, 702
See application file for complete search history.

(56) References Cited

U.S. PATENT DOCUMENTS

| | | | | |
|---|---|---|---|---|
| 2,507,528 | A | 5/1950 | Kandoian | |
| 3,172,112 | A * | 3/1965 | Seeley | 343/767 |
| 4,197,545 | A | 4/1980 | Favaloro et al. | |
| 4,367,475 | A | 1/1983 | Schiavone | |
| 4,843,403 | A * | 6/1989 | Lalezari et al. | 343/767 |
| 5,175,560 | A * | 12/1992 | Lucas et al. | 343/767 |
| 5,489,913 | A * | 2/1996 | Raguenet et al. | 343/767 |
| 5,581,266 | A | 12/1996 | Peng et al. | |
| 6,677,909 | B2 * | 1/2004 | Sun et al. | 343/767 |
| 7,057,569 | B2 * | 6/2006 | Isoifovich et al. | 343/770 |
| 8,378,910 | B2 * | 2/2013 | Wolf | 343/768 |
| 8,629,812 | B2 * | 1/2014 | Jaffri | H01Q 13/18 343/767 |
| 2009/0153410 | A1 | 6/2009 | Chiang et al. | |
| 2009/0256757 | A1 | 10/2009 | Chiang et al. | |
| 2010/0053011 | A1 * | 3/2010 | Kurashima | H01Q 13/10 343/767 |

FOREIGN PATENT DOCUMENTS

| | | | |
|---|---|---|---|
| EP | 2117074 | A1 | 11/2009 |
| EP | 2445053 | A1 | 4/2012 |
| EP | 2509158 | A2 | 10/2012 |
| WO | 01/47059 | A | 6/2001 |
| WO | 02/39547 | A1 | 5/2002 |
| WO | 2010/098564 | A2 | 9/2010 |

OTHER PUBLICATIONS

European Search Report dated Oct. 27, 2014 in a counterpart European application No. EP13004344.1 (All the references cited therein are listed herein.).

* cited by examiner

*Primary Examiner* — Hoang V Nguyen
(74) *Attorney, Agent, or Firm* — The PL Law Group, PLLC

(57) ABSTRACT

An antenna includes a substrate, a feed line formed on one surface of the substrate, a ground plane formed on the other surface of the substrate, a short-circuit stub that extends from a terminating end of the feed line and contacts the ground plane, and slits formed on the ground plane so as to cross the feed line.

9 Claims, 11 Drawing Sheets

(a)

(b)

(a)

(b)

(a)

(b)

(a) A = B (b) A < B

ANTENNA

CROSS-REFERENCE TO RELATED APPLICATION AND CLAIM OF PRIORITY

This application claims priority to and the benefit of Korean Patent Application No. 10-2013-0061791, filed on May 30, 2013, the disclosure of which is incorporated herein by reference in its entirety.

BACKGROUND

1. Field of the Invention

The present invention relates to an antenna, and more particularly, to an antenna having slits.

2. Discussion of Related Art

An antenna receives/transmits a signal to/from a wireless device and is a pivotal device that determines the quality of wireless communications. Recently, as information technology (IT) continues to develop, the wireless device is becoming smaller in size and lighter in weight. In order to follow this trend, a greater portion of the antenna mounted on the wireless device has been replaced with an embedded-type antenna in lieu of an externally mounted-type antenna.

A considerable amount of research on improvements in the performance of the embedded-type antenna has been conducted. As part of this research, an antenna has been developed to improve wider bandwidth characteristics of the embedded-type antenna. In such an antenna, a current flows through slots having predetermined lengths and predetermined widths such that the bandwidth of the antenna can be increased. However, in an antenna according to the related art, as illustrated in FIG. 1, a radiation pattern is formed solely perpendicular to an upward direction of a slot (i.e., in an upward direction of a substrate) and a peak gain of the radiation pattern is shown in only one direction. The radiation pattern of the antenna needs to accommodate different directions/orientations, in relation to the upward direction of the slot, according to an environment in which the wireless device is used, and this demand is not realized by existing antennae.

SUMMARY

The present invention is directed to an antenna in which a radiation pattern is capable of being formed in different directions/orientations compared to the sole direction of a radiation pattern of an antenna according to the related art.

According to one aspect of the present invention, provided is an antenna including: a substrate; a feed line formed on one surface of the substrate; a ground plane formed on the other surface of the substrate; a short-circuit stub that extends from a terminating end of the feed line and contacts the ground plane; and slits formed on the ground plane so as to cross the feed line.

The ground plane may be a metal rear case.

The substrate may be a ferrite sheet.

The antenna may further include an additional stub that extends from one side of the feed line.

At least one end of each of the slits may be open from an end of the ground plane to an external space.

The slits may be formed from one end completely to the other end of the ground plane, and each end of each slit may be open from the ends of the ground plane to external spaces.

The slits may be formed on the ground plane so as to perpendicularly cross the feed line.

A coupling point at which coupling between each slit and the feed line occurs, may be formed at each of the slits, and the slits may have the same length at both ends thereof based on the coupling point.

The antenna may further include additional slits formed on the ground plane so as to cross the slits.

BRIEF DESCRIPTION OF THE DRAWINGS

The above and other objects, features, and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of an antenna according to the present invention will be described in detail below with reference to FIGS. 2 through 14. Descriptions of well-known functions or constructions may be omitted for clarity. While parts of the present invention are named and described below with reference to their functionalities, alternative terminology may be employed, as desired by a user, operator, or according to conventional practice, without altering the content of the disclosure.

Furthermore, while exemplary embodiments of the present invention are described below in sufficient detail to enable those of ordinary skill in the art to make and use the present invention, it is important to understand that the present invention may be embodied in many alternative forms and should not be construed as limited to the example embodiments set forth herein.

Figure 1:
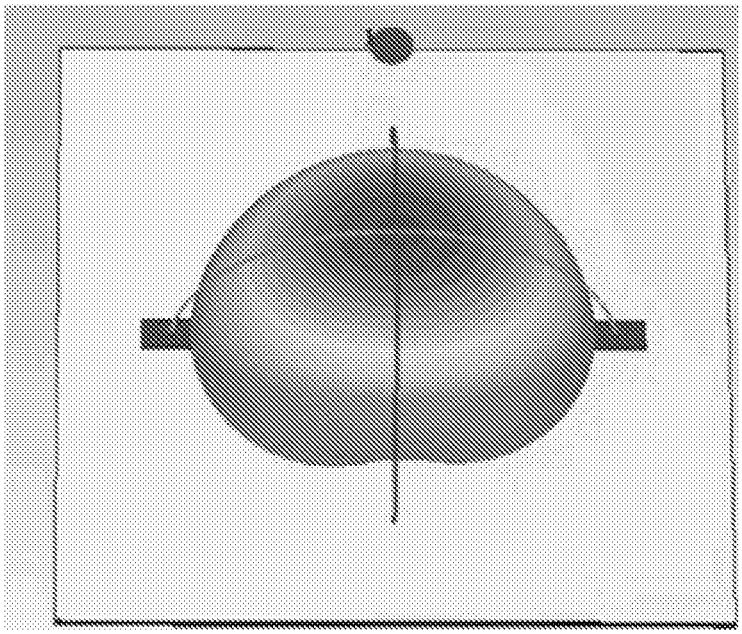
FIG. 1 illustrates a radiation pattern of an antenna according to the related art.
Figure 2:
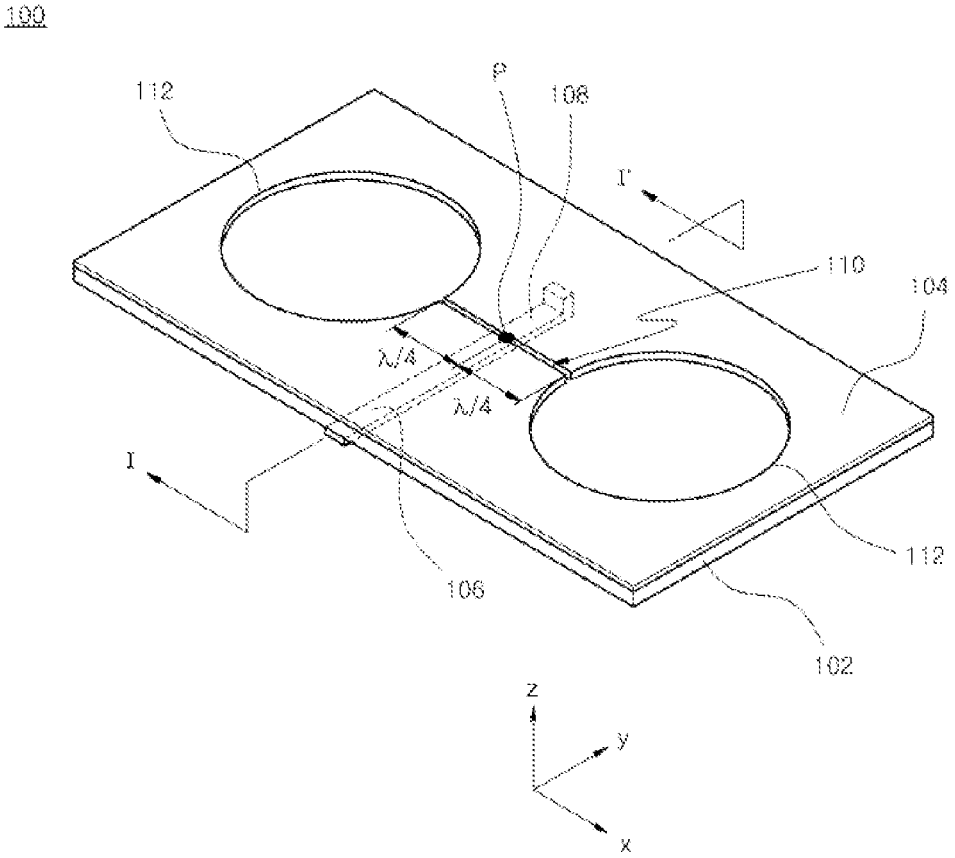
FIG. 2 is a front perspective view of an antenna according to an embodiment of the present invention.
Figure 3:
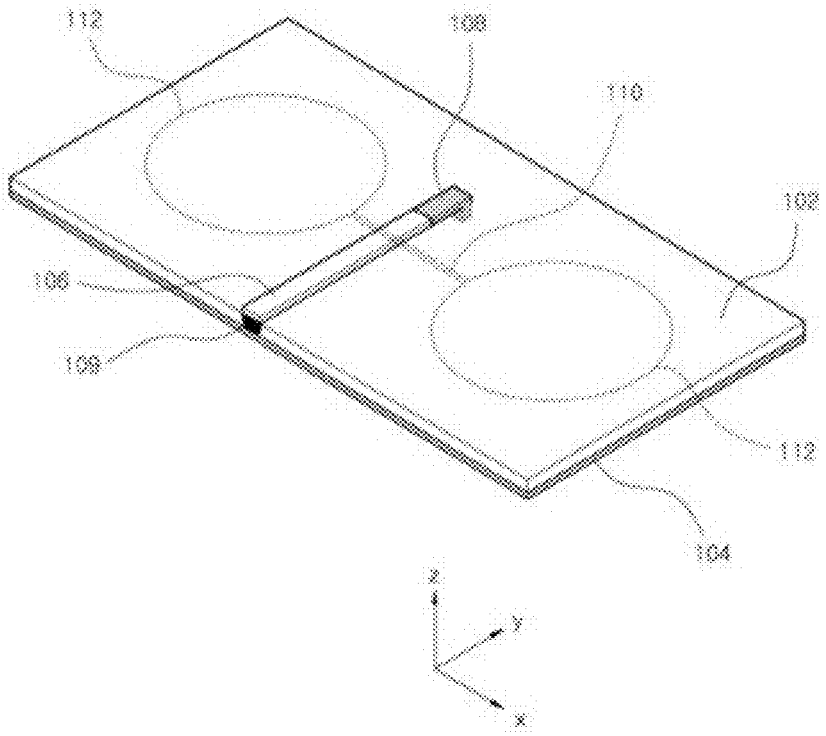
FIG. 3 is a rear perspective view of the antenna illustrated in FIG. 2.
Figure 4:
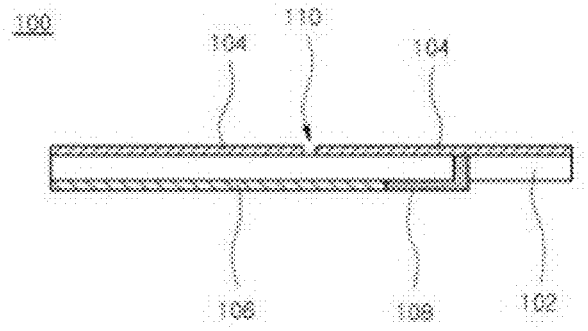
FIG. 4 is a cross-sectional view taken along a line I-I' of FIG. 2.

FIG. 2 is a front perspective view of an antenna according to one embodiment of the present invention, FIG. 3 is a rear perspective view of the antenna illustrated in FIG. 2, and FIG. 4 is a cross-sectional view taken along a line I-I' of FIG. 2.

Referring to FIGS. 2 through 4, an antenna 100 includes a substrate 102, a ground plane 104, a feed line 106, a short-circuit stub 108, slits 110, and slots 112.

The feed line 106 and the short-circuit stub 108 are formed on one surface of the substrate 102. For example, the substrate 102 may be formed of a dielectric having a predetermined dielectric constant. A resonant frequency of the antenna 100 varies according to the dielectric constant and thickness of the substrate 102. However, aspects of the present invention are not limited thereto, and the substrate 102 may be formed of a member having a predetermined dielectric constant and predetermined permeability. For example, the substrate 102 may be formed of a ferrite sheet. In this case, since a resonant length (i.e., an electrical length of the antenna 100) can be reduced, the size of the antenna 100 can be reduced. The resonant length of the antenna 100 may be shown using Equation 1.

$$\lambda = \frac{\lambda_0}{\sqrt{\varepsilon_r \times \mu_r}} \qquad \text{Equation 1}$$

Here, $\lambda$ is a wavelength of a signal transmitted and received by the antenna 100, $\lambda_0$ is a wavelength of the signal in a free space, $\in_r$ is a relative dielectric constant of the ferrite sheet, and $\mu_r$ is relative permeability of the ferrite sheet. According to Equation 1, the resonant length of the antenna 100 decreases as the relative dielectric constant and relative permeability of the ferrite sheet (i.e., the substrate 102) increase. That is, since the ferrite sheet has not only a dielectric constant, but also permeability, when the ferrite sheet is used as the substrate 102, the resonant length of the antenna 100 can be reduced, therefore, the antenna 100 can be miniaturized. In this case, a signal in a low frequency band, for example, 13.56 MHz, can be received/transmitted to/from the antenna 100.

The ground plane 104 is formed on the other surface of the substrate 102. The ground plane 104 is formed of a conductive material. The ground plane 104, for example, may be a metal rear case. That is, when the antenna 100 is mounted on a mobile communication terminal, the metal rear case within the mobile communication terminal may be used as the ground plane 104. In this case, a portion of the ground plane 104 is removed so that the slits 110 and the slots 112 are formed. When the metal rear case is used as the ground plane 104, a portion of the metal rear case is removed so that the slits 100 and the slots 112 are formed.

The feed line 106 is formed on one surface of the substrate 102 with a predetermined length. The length of the feed line 106 may be adjusted to be a 50Ω feed line for impedance matching. The feed line 106 may be formed on one surface of the substrate 102 in a widthwise direction of the substrate 102 (i.e., along the y-axis), however, aspects of the present invention are not limited thereto. The feed line 106 may be formed, for example, using a microstrip line. Power is supplied to the feed line 106 from a feed point 109 formed at one end of the feed line 106 so that the feed line 106 performs a feed function. In this case, power may be fed to the feed line 106 in a direct feed or coupling feed manner. However, aspects of the present invention are not limited thereto, and power may be fed to the feed line 106 in various other feed manners than the direct feed or coupling feed manner.

The short-circuit stub 108 is formed at the other end of the feed line 106 and is connected to the feed line 106. The short-circuit stub 108 may be formed, for example, to a length of $3\lambda/4$. Here, $\lambda$, represents a wavelength at the resonant frequency of the antenna 100. The short-circuit stub 108 is formed with a length of $3\lambda/4$ so that frequency tuning to the resonant frequency of the antenna 100 can be performed. In this case, a terminating end of the short-circuit stub 108 may be formed by perforating the substrate 102 and may make contact with the ground plane 104. However, aspects of the present invention are not limited thereto, and the short-circuit stub 108 may be formed in various shapes in which the short-circuit stub 108 contacts the ground plane 104.

The slits 110 are formed on the ground plane 104 so as to cross the feed line 106. In this case, each of the slits 110 is spaced apart from the feed line 106 by a predetermined gap in a state in which the substrate 102 is placed between each slit 110 and the feed line 106. Thus, coupling between each slit 110 and the feed line 106 occurs.

When each slit 110 perpendicularly crosses the feed line 106, the intensity of coupling that occurs between each slit 110 and the feed line 106 can be maximized. For example, when the slit 110 is formed in a lengthwise direction of the substrate 102 (i.e., along the x-axis) and perpendicularly crosses the feed line 106 formed in the widthwise direction of the substrate 102 (i.e., along the y-axis) the intensity of coupling that occurs between the slit 110 and the feed line 106 can be maximized. Detailed descriptions thereof are provided below.

The slit 110 includes a coupling point P at which power is fed from the feed line 106 by coupling. The coupling point P may be formed at a portion where the slit 110 and the feed line 106 cross each other. The slits 110 may be formed, for example, at both sides of the ground plane 104 to the same length based on the coupling point P. More specifically, the slits 110 may be formed at both sides of the ground plane 104 to the length of $\lambda/4$ based on the coupling point P. The slits 110 are formed at both sides of the ground plane 104 to the length of $\lambda/4$ based on the coupling point P so that frequency tuning to the resonant frequency of the antenna 100 can be performed. As such, the resonant frequency of the antenna 100 can be adjusted according to the length of the slit 110.

The slots 112 may be formed at both ends of the slit 110 on the ground plane 104. Here, the slots 112 are formed at both ends of the slit 110, however, aspects of the present invention are not limited thereto, and the slots 112 may be formed only at one end of the slit 110. Each of the slots 112 are formed to be connected to each of the slits 110 so that each slot 112 has an open part formed by the slit 110. In this case, radiation in the slots 112 can be more smoothly realized. Although not shown, an opposite side of the slot 112, with a portion of the slot 112 connected to the slit 110, may be open. In this case, the resonant frequency of the antenna 100 can be tuned through the open part.

Each of the slots 112 may be formed, for example, to have a circular opening. In this case, a current may smoothly flow through the slot 112. However, the shape of the opening formed by the slot 112 is not limited to a circular shape, and the opening may be formed in various other shapes other than a circular shape. Ultimately, the resonant frequency of the antenna 100 varies according to the size and shape of the slot 112.

In the antenna 100 having the above circular slot 112 configuration, when a current is supplied to the feed line 106 from the feed point 109, the supplied current flows through the feed line 106 and the short-circuit stub 108. In this case, the current that flows through the feed line 106 is fed to the slit 110 via the aforementioned coupling that occurs in a portion where the feed line 106 and the slit 110 cross each other.

The current fed to the slit 110 via coupling is supplied to both ends of the slit 110 based on the coupling point P. In this case, the current fed to the slit 110 via coupling is equally distributed to the coupling point P and flows equally into each of the slots 112. Here, the slit 110 serves as a current path with which the current is fed from the feed line 106 and transferred to each slot 112.

The current that flows in the slot 112 flows through the circumference of the slot 112, and radiation occurs in the slot 112. Here, when the opening of the slot 112 has a circular shape, the current smoothly flows through the slot 112 so that the radiation can be smoothly realized. In this case, the current being radiated through the slot 112, corresponding to a frequency bandwidth in a resonant frequency band of the antenna 100, can be enlarged. That is, since the current flowing through the circumference of the slot 112—having a predetermined size and radiation—can be enlarged, the frequency bandwidth in the resonant frequency band of the antenna 100 can be enlarged.

Since a portion of the slot 112 is opened via the slit 110, the flow of the current can occur from one slot 112 towards the direction of the other slot 112, via slit 110, and thus can be smoother. In this case, since radiation occurs even within the slit 110, the intensity of a radiation beam is increased so that the performance of the antenna 100 (e.g., antenna gain and antenna efficiency) can be improved. That is, in the antenna 100 illustrated in FIG. 2, the slots 112 and the slits 110 serve as a radiator that transmits and receives a signal.

The resonant frequency and frequency bandwidth for the antenna 100 are determined by the thickness and dielectric constant of the substrate 102, the length of the slit 110, and the size and shape of the slot 112.

Figure 5:
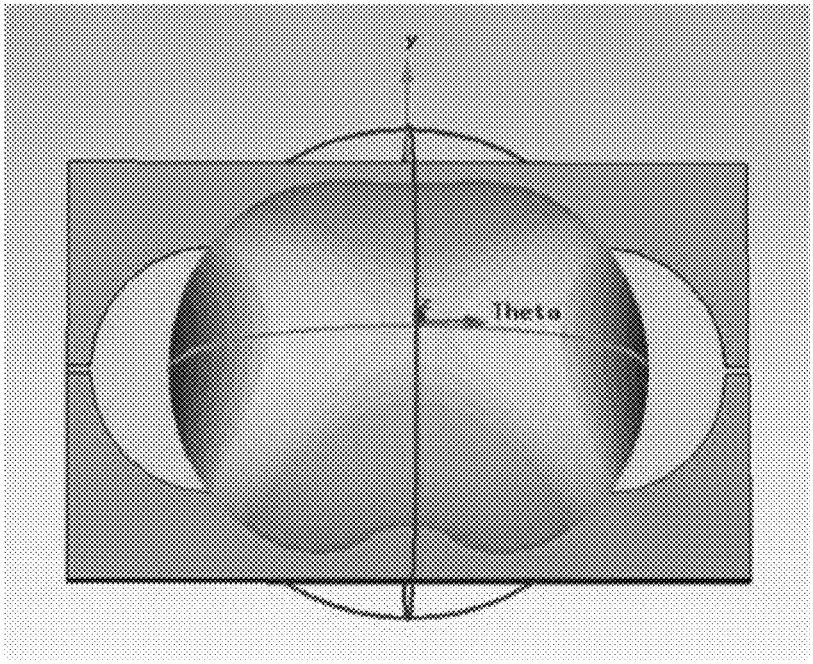
FIG. 5 illustrates a radiation pattern of the antenna of FIG. 2.

FIG. 5 illustrates a radiation pattern of the antenna of FIG. 2.

Referring to FIG. 5, in the antenna 100 of FIG. 2, since the current flows in the slots 112 formed at both ends of the slit 110, from the center of the slit 110, and is distributed along the slots 112, a radiation pattern can be formed in a direction of each slot 112 (i.e., in the direction of both side surfaces of the substrate 102) from the center of each slit 110, and peak gain occurs in both directions of the radiation pattern.

In this way, in the antenna according to the present invention, the radiation pattern can be formed in different directions compared to a sole direction in which a radiation pattern of an antenna according to the related art is formed. Thus, antenna directivity that cannot be realized by the antenna according to the related art can be achieved.

In the antenna 100 of FIG. 2, coupling occurs between the feed line 106 and the slit 110 in an embodiment in which the substrate 102 is placed between the feed line 106 and the slit 110. In this case, the intensity of coupling can vary according to the angle at which the slit 110 and the feed line 106 cross each other. That is, when current is supplied to the feed line 106 from the feed point 109, the supplied current forms coupling with the slit 110 at a portion where the supplied current proceeds along the feed line 106 and crosses the slit 110. In this case, the intensity of coupling varies according to the crossing angle of the feed line 106 and the slit 110, and the intensity of radiation from the slots 112 varies according to the intensity of coupling.

Figure 6:
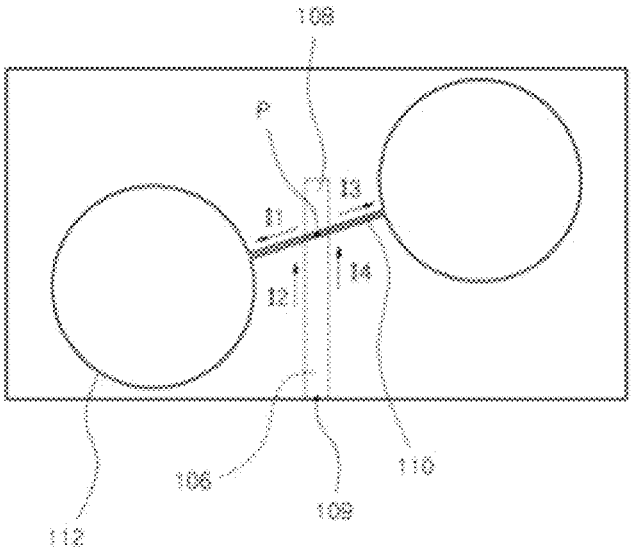
FIG. 6 illustrates an embodiment in which a feed line and a slit diagonally cross each other.

FIG. 6 illustrates a case in which the feed line 106 and the slit 110 diagonally (i.e., non-perpendicularly) cross each other. Referring to FIG. 6, when the slit 110 diagonally crosses the feed line 106, a current I1 flowing through a left end of the slit 110 and a current I3 flowing through a right end of the slit 110, based on the coupling point P, collide with currents I2 and I4 flowing from the feed point 109 through feed line 106 to the short-circuit stub 108 resulting in reduced strength of coupling.

Figure 7:
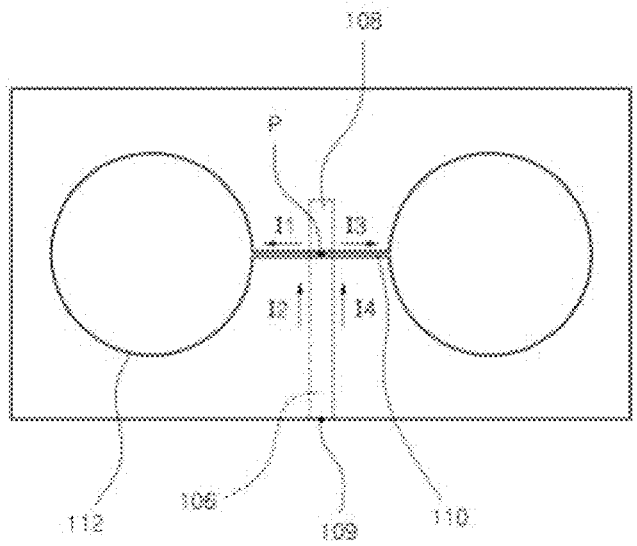
FIG. 7 illustrates an embodiment in which the feed line and the slit perpendicularly cross each other.

Conversely, when the slit 110 perpendicularly crosses the feed line 106, as illustrated in FIG. 7, the currents I1 and I3 flowing through both ends of the slit 110, based on the coupling point P, are not affected by the currents I2 and I4 flowing from the feed point 109 through feed line 106 to the short-circuit stub 108 resulting in maximum intensity of coupling. In this case, since the intensity of radiation in the slots 112 can be maximized, the antenna 100 can, therefore, be miniaturized. That is, since strong radiation occurs in the slots 112, the desired performance of the antenna 100 can be obtained even when the antenna 100 is miniaturized.

Figure 8:
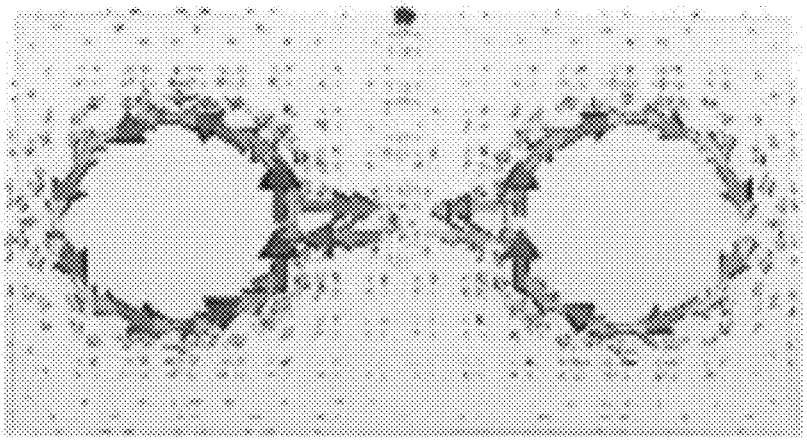
FIG. 8 illustrates current distribution characteristics of the antenna of FIG. 2.

FIG. 8 illustrates current distribution characteristics of the antenna of FIG. 2.

Referring to FIG. 8, in the antenna 100 of FIG. 2, a current flow through the circumference of each slot 112. A current flows from one slot 112 to another slot 112 through each slit 110. In this case, radiation from the slot 112 and the slit 110 is smooth so that the antenna 100 may perform the function of an antenna optimally.

Figure 9:
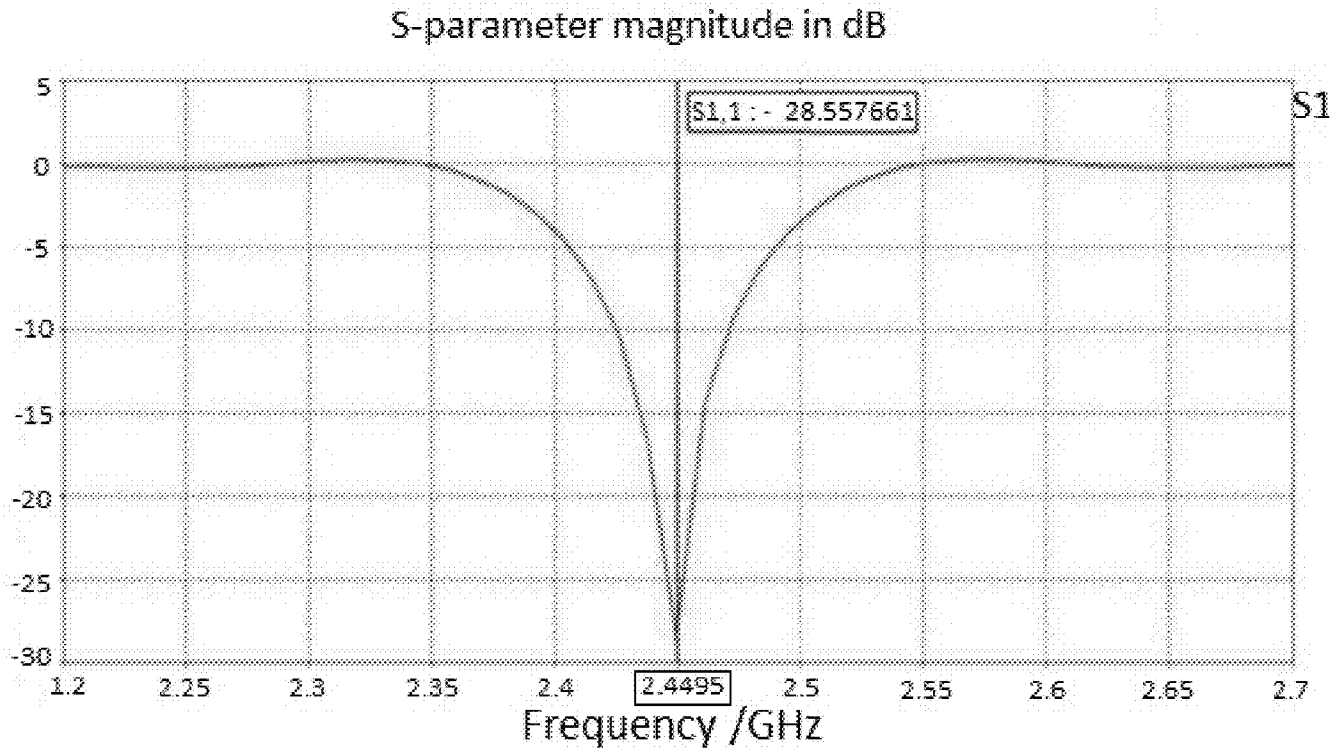
FIG. 9 is a graph showing reflection losses of the antenna of FIG. 2.

FIG. 9 is a graph showing reflection losses (S1,1) of the antenna of FIG. 2. Here, the substrate 102 was an alumina substrate having a relative dielectric constant of 9.9, the thickness of the substrate 102 was 0.8 mm, and the size of the substrate 102 was 25 mm×15 mm.

Referring to FIG. 9, a resonant frequency of the antenna 100 was established at 2.45 GHz. In this case, the reflection losses of the antenna 100 were −28.5 dB. Thus, the antenna 100 could serve as an excellent antenna in a wireless fidelity (Wi-Fi) and Bluetooth bandwidth. When a ferrite sheet was used as the substrate 102, the antenna 100 could also transmit and receive a signal in a low frequency bandwidth.

Figure 10A:
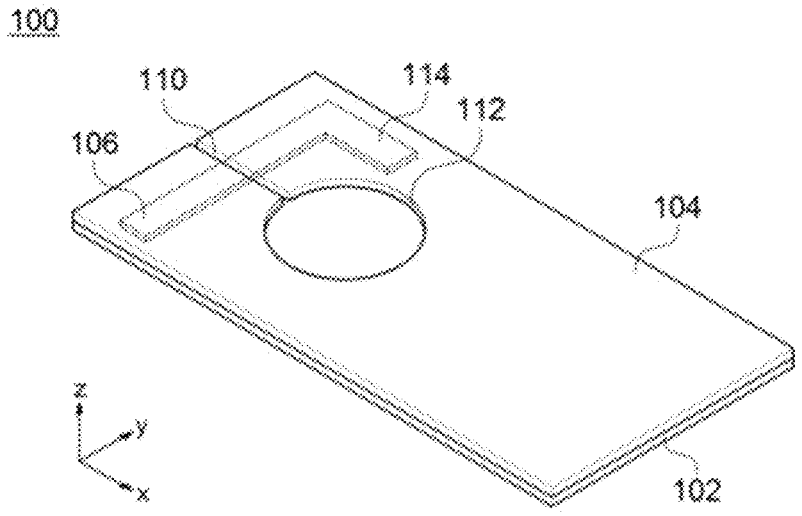
FIGS. 10A and 10B illustrate an antenna according to another embodiment of the present invention.
Figure 10B:
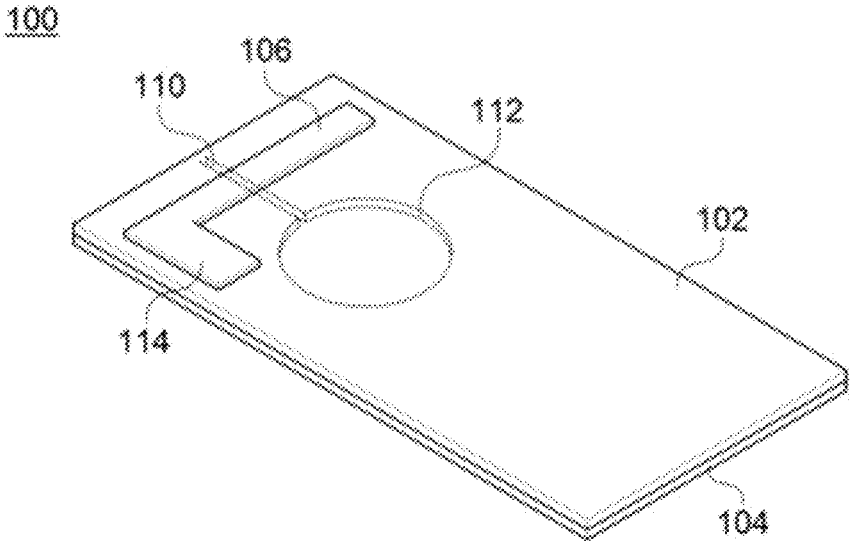

FIGS. 10A and 10B illustrate an antenna 100 according to another embodiment of the present invention.

Referring to FIGS. 10A and 10B, a feed line 106 is formed on one surface of a substrate 102. The feed line 106 may be formed in a widthwise direction of the substrate 102 (i.e., along the y-axis). In this case, an additional stub 114 may extend from one side of the feed line 106. The additional stub 114 may adjust the resonant frequency of the antenna 100. The additional stub 114 may be an opened stub. However, aspects of the present invention are not limited thereto, and the additional stub 114 may be a short-circuit stub.

A ground plane 104 is formed on the other surface of the substrate 102. A metal rear case, for example, may be used as the ground plane 104. Slits 110 and slots 112 may be formed on the ground plane 104. In this case, one end of each slit 110 may be open from an end of the ground plane 104 to the external space. That is, an external space opening may be formed at one end of the slit 110. Slot 112 may be formed on the other end of the slit 110. The slit 110 may be formed in a lengthwise direction of the substrate 102 (i.e., along the x-axis) so as to perpendicularly cross the feed line 106.

Here, the external space opening formed at one end of the slit 110 serves as a kind of slot. In this case, the direction of the radiation pattern of the antenna 100 is biased towards the direction of the external space opening formed at one end of the slit 110. Thus, the radiation pattern of the antenna 100 has certain directionality.

Figure 11A:
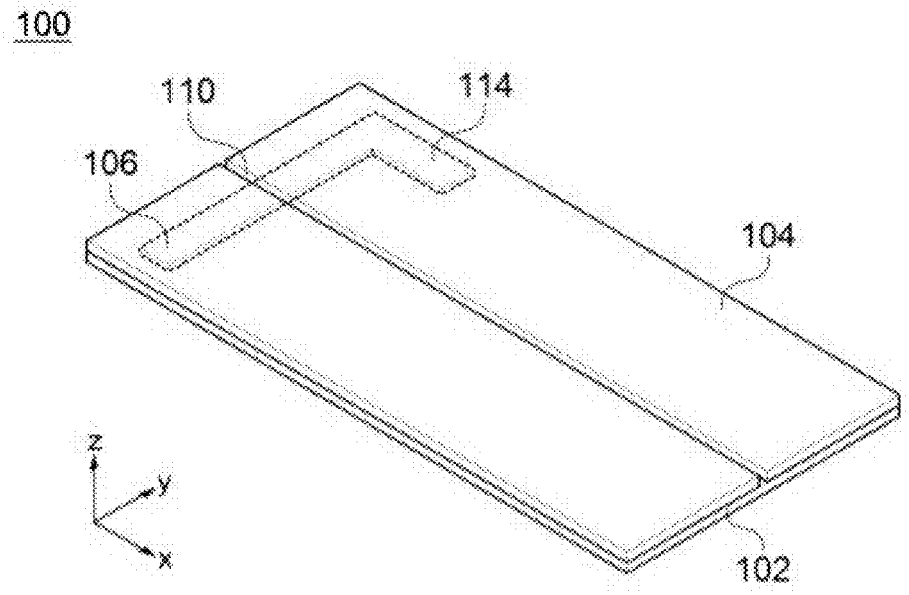
FIGS. 11A and 11B illustrate an antenna according to another embodiment of the present invention.
Figure 11B:
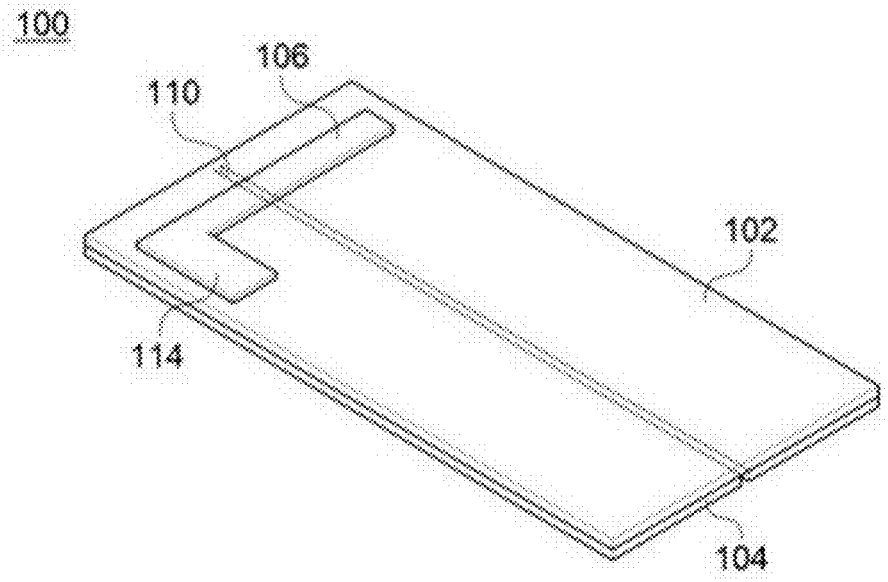

FIGS. 11A and 11B illustrate an antenna 100 according to another embodiment of the present invention.

Referring to FIGS. 11A and 11B, a feed line 106 is formed on one surface of a substrate 102. The feed line 106 may be formed in a widthwise direction of the substrate 102 (i.e., along the y-axis). In this case, an additional stub 114 may extend from one side of the feed line 106.

A ground plane 104 is formed on the other surface of the substrate 102. Slits 110 may be formed on the ground plane 104. The slits 110 may be formed in a lengthwise direction of the ground plane 104 from one end completely to the other end of the ground plane 104 (i.e., along the x-axis). In this case, both ends of each slit 110 may be open to the external space. That is, an external space opening may be formed at each end of the slit 110. In this case, since the external space opening formed at each end of the slit 110 serves as a kind of slot, no additional slots (e.g., 112) are required. In this case, the direction of the radiation pattern of the antenna 100 is formed towards the direction of the external space opening formed at each end of the slit 110. Here, the feed line 106 is formed at one end of the substrate 102. However, aspects of the present invention are not limited thereto, and the feed line 106 may be formed to cross the center of each slit 110 (i.e., in the center of substrate 102).

Figure 12A:
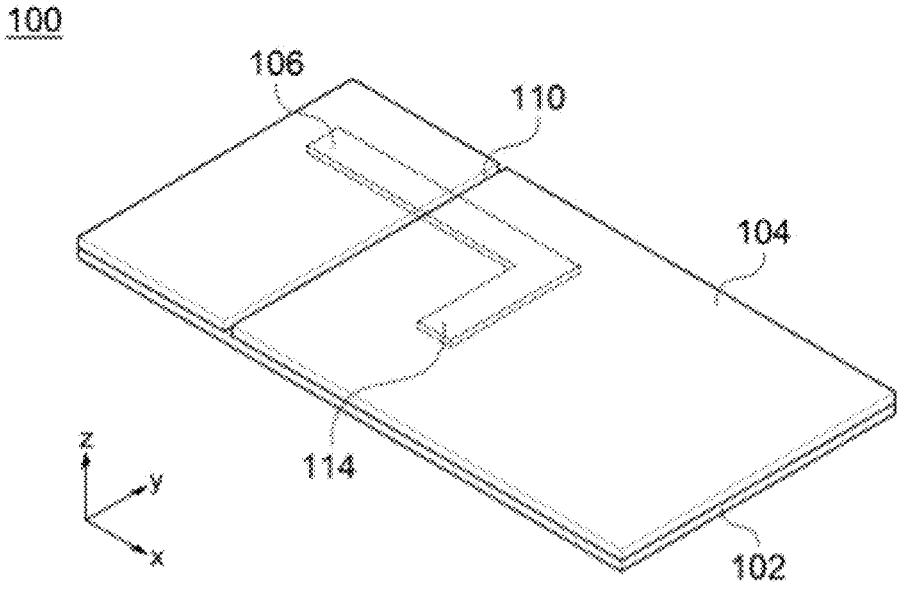
FIGS. 12A and 12B illustrate an antenna according to another embodiment of the present invention.
Figure 12B:
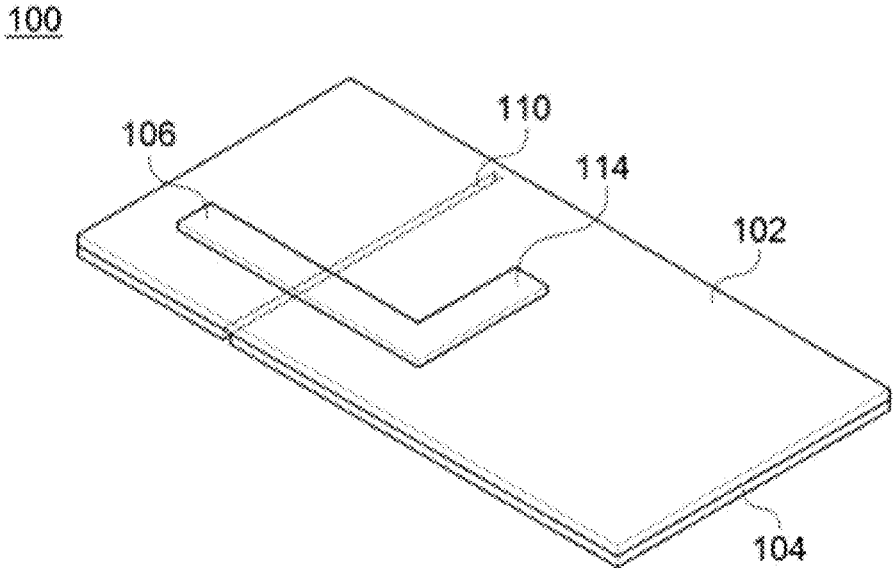

FIGS. 12A and 12B illustrate an antenna 100 according to another embodiment of the present invention.

Referring to FIGS. 12A and 12B, a feed line 106 is formed on one surface of a substrate 102. The feed line 106 may be formed in a lengthwise direction of the substrate 102 (i.e., along the x-axis). In this case, an additional stub 114 may extend from one side of the feed line 106.

A ground plane 104 is formed on the other surface of the substrate 102. Slits 110 may be formed on the ground plane 104. The slits 110 may be formed in a widthwise direction of the ground plane 104 from one end completely to the other end of the ground plane 104 (i.e., along the y-axis). In this case, both ends of the slit 110 may be open to an external space. That is, an external space opening may be formed at each end of the slit 110. In this case, since the external space opening formed at each end of the slit 110 serves as a kind of slot, no additional slots (e.g., 112) are required. In this case, the direction of the radiation pattern of the antenna 100 is formed towards the direction of the external space opening formed at each end of the slit 110. Here, the feed line 106 is formed along one of the longer sides of the substrate 102. However, aspects of the present invention are not limited thereto, and the feed line 106 may be formed to cross the center of each slit 110 (i.e., along the center of the width of substrate 102).

Figure 13A:
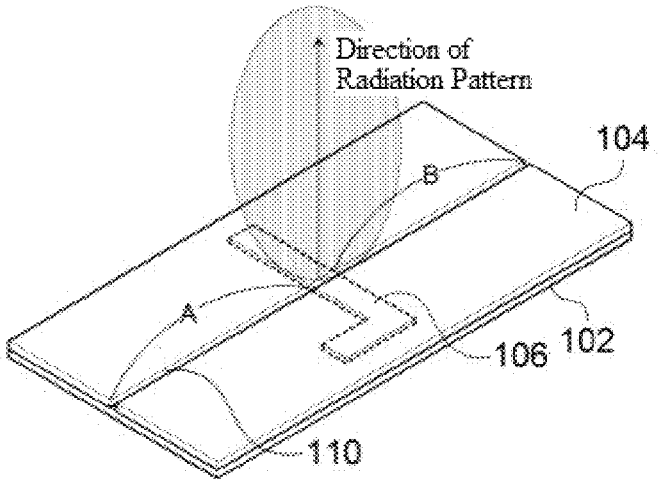
FIGS. 13A through 13C illustrate a change in the direction of a radiation pattern according to the symmetrical or asymmetrical lengths of slits of an antenna according to different embodiments of the present invention.
Figure 13B:
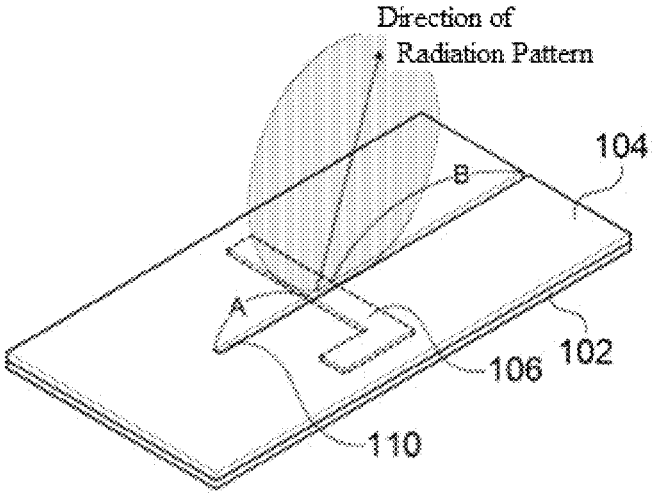
Figure 13C:
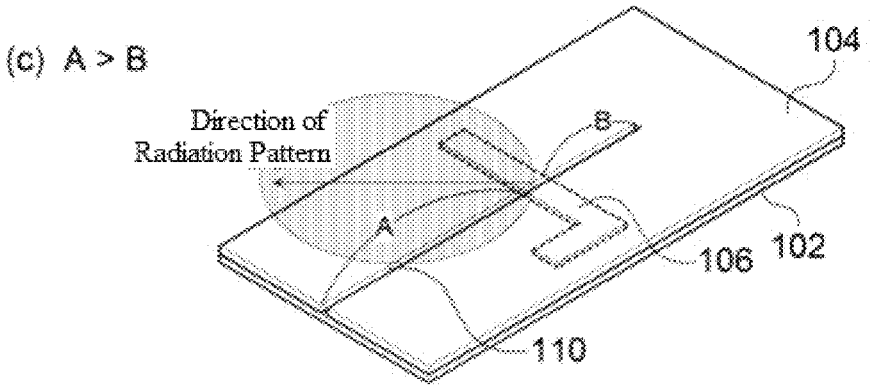

FIGS. 13A through 13C illustrate a change in the direction of a radiation pattern according to the symmetry of the slits of an antenna according to an embodiment of the present invention.

Referring to FIG. 13A, slits 110 may be formed in a lengthwise direction of a ground plane 104 from one end completely to the other end of the ground plane 104. A feed line 106 formed on the substrate 102 may perpendicularly cross each of the slits 110 in center of the slit 110 (i.e., the center of the lengthwise direction of ground plane 104). In this case, the slits 110 are symmetrical in length and opposite to each other based on the feed line 106. That is, a left length A and a right length B of the slit 110 have equal lengths based on the feed line 106. In this case, the direction of the radiation pattern of the antenna 100 is formed perpendicular to the ground plane 104.

Referring to FIG. 13B, the slits 110 may be formed in a lengthwise direction of the ground plane 104 from one end of the ground plane 104 to predetermined lengths. In this case, the slits 110 may be open from only one end of the ground plane 104 to the external space. That is, the slits 110 may be formed to predetermined lengths that are from one end of the ground plane 104 and do not reach the other end of the ground plane 104. The feed line 106 may be formed across the center of the substrate 102. In this case, the slits 110 may have asymmetrical lengths opposite to one another based on the feed line 106. That is, the left length A of each slit 110 may have a smaller length than the right length B of each slit 110 based on the feed line 106. In this case, the direction of the radiation pattern of the antenna 100 is oriented towards the longer right length B of the slit 110.

Referring to FIG. 13C, the slits 110 may be formed in a lengthwise direction of the ground plane 104 from the opposite end of the ground plane 104 (i.e., with respect to FIG. 13B) to predetermined lengths. In this case, the slits 110 may be open from only the opposite end of the ground plane 104 to the external space. That is, the slits 110 may be formed to predetermined lengths that are from the opposite end of the ground plane 104 and do not reach the other end of the ground plane 104. The feed line 106 may be formed across the center of the substrate 102. In this case, the slits 110 have asymmetrical lengths opposite to one another based on the feed line 106. That is, the left length A of the slit 110 has a longer length than the right length B of the slit 110 based on the feed line 106. In this case, the direction of the radiation pattern of the antenna 100 is oriented towards the left length A of the slit 110.

In this way, when the slits 110 have symmetrical lengths opposite to one another based on the feed line 106, the direction of the radiation pattern of the antenna 100 is formed perpendicular to the ground plane 104. When the slits 110 have asymmetrical lengths opposite to one another based on the feed line 106, the direction of the radiation pattern of the antenna 100 is oriented towards the direction of the slit 110 having the longer length based on the feed line 106.

Figure 14:
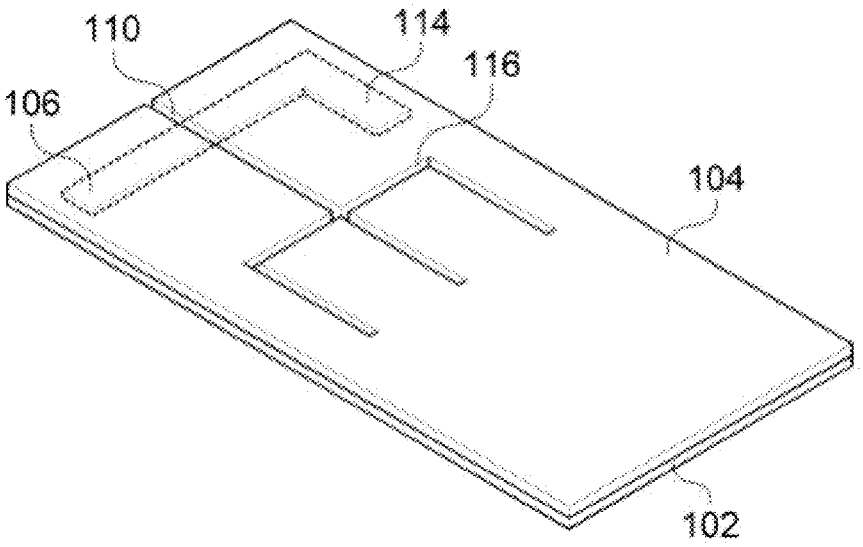
FIG. 14 illustrates an antenna according to another embodiment of the present invention.

FIG. 14 illustrates an antenna according to another embodiment of the present invention.

Referring to FIG. 14, slits 110 may be formed in a lengthwise direction of a ground plane 104 from one end of the ground plane 104 to predetermined lengths. In this case, the slits 110 may be open from only one end of the ground plane 104 to the external space. However, aspects of the present invention are not limited thereto, and the slits 110 may be formed to completely traverse the ends of the ground plane 104.

Additional slits 116 may be formed on the ground plane 104. Additional slits 116 may cross the slits 110. When additional slits 116 are formed on the ground plane 104, the resonant frequency of the antenna 100 may be moved to a low frequency band through enlargement of the entire slit length. Here, additional slits 116 cross the slits 110 and have a "pitchfork" shape. However, the shapes of additional slits 116 are not limited thereto, and additional slits 116 may be formed in various other shapes other than the "pitchfork" shape of FIG. 14.

As described above, in an antenna according to one or more embodiments of the present invention, a feed line is formed on one surface of a substrate, slits are formed on the other surface of the substrate so as to cross the feed line, and slots are formed at both ends of the slits so that a radiation pattern of the antenna can be formed with varying directionality compared to a single radiation pattern of an antenna according to the related art, and thus antenna directionality can be achieved with variable orientations that cannot be realized by the antenna according to the related art.

In addition, a current caused by coupling between the feed line and each of the slits can be distributed into the slots formed at both ends of the slits and the resulting current can give rise to radiation. In this case, when the feed line and each slit perpendicularly cross one another, the intensity of coupling is maximized, and the intensity of radiation in the slots is maximized. Thus, the antenna can be miniaturized, and the performance of the antenna (e.g., antenna gain and antenna efficiency) can be improved. Furthermore, at least one end of each of the slits is formed to be open to an external space so that the direction of the radiation pattern of the antenna can be formed in an orientation that is biased towards the direction of the external space formed at the open end of each slit without the use of additional slots.

It will be apparent to those skilled in the art that various modifications can be made to the above description of exemplary embodiments of the present invention without departing from the spirit or scope of the invention. Thus, it is intended that the present invention cover all such modifications, provided they fall within the scope of the appended claims and their equivalents.

What is claimed is:

1. An antenna comprising:

a substrate;

a feed line formed in a direction on one surface of the substrate;

a ground plane formed on the other surface of the substrate;

a short-circuit stub that extends in the same direction with the feed line from a terminating end of the feed line for tuning a resonant frequency of the antenna, wherein a terminating end of the short-circuit stub makes contact with the ground plane; and a slit formed on the ground plane so as to cross the feed line.

2. The antenna of claim 1, wherein the ground plane is a metal rear case.

3. The antenna of claim 1, wherein the substrate is a ferrite sheet.

4. The antenna of claim 1, further comprising an additional stub that extends from one side of the feed line.

5. The antenna of claim 1, wherein at least one end of the slit is open from an end of the ground plane to an external space.

6. The antenna of claim 5, wherein the slit is formed from one end to the other end of the ground plane, and each end of the slit is open from an end of the ground plane to an external space.

7. The antenna of claim 1, wherein the slit is formed on the ground plane so as to perpendicularly cross the feed line.

8. The antenna of claim 1, wherein a coupling point, at which coupling between the slit and the feed line occurs, is formed on each of the slit, and the slit has the same symmetrical length on both ends thereof based on the coupling point.

9. The antenna of claim 1, further comprising additional slit formed on the ground plane so as to cross the slit.

* * * * *